US008096250B2

(12) United States Patent
Takeshita

(10) Patent No.: US 8,096,250 B2
(45) Date of Patent: Jan. 17, 2012

(54) THREADING TENSIONING DEVICE OF SEWING MACHINE

(75) Inventor: Koji Takeshita, Tokyo (JP)

(73) Assignee: Juki Corporation, Chofu-shi, Tokyo (JP)

( * ) Notice: Subject to any disclaimer, the term of this patent is extended or adjusted under 35 U.S.C. 154(b) by 503 days.

(21) Appl. No.: 12/335,945

(22) Filed: Dec. 16, 2008

(65) Prior Publication Data

US 2009/0165687 A1 Jul. 2, 2009

(30) Foreign Application Priority Data

Dec. 17, 2007 (JP) ..... P. 2007-324624

(51) Int. Cl.
*D05B 47/04* (2006.01)
*D05B 47/00* (2006.01)

(52) U.S. Cl. ..... 112/254

(58) Field of Classification Search ..... 112/302, 112/254, 255

See application file for complete search history.

(56) References Cited

U.S. PATENT DOCUMENTS 2,725,840 A * 12/1955 Zeier ..... 112/254
4,254,723 A * 3/1981 Rothstein ..... 112/255
4,726,308 A * 2/1988 Aida et al. ..... 112/254
4,803,936 A * 2/1989 Mikuni et al. ..... 112/254
5,156,105 A * 10/1992 Wang ..... 112/254
5,265,548 A 11/1993 Satoma
5,860,376 A * 1/1999 Tseng ..... 112/255
6,957,616 B1 * 10/2005 Chang ..... 112/254
7,069,869 B2 * 7/2006 Kashina ..... 112/254

* cited by examiner

*Primary Examiner* — Ismael Izaguirre

(74) *Attorney, Agent, or Firm* — Drinker Biddle & Reath LLP

(57) ABSTRACT

A thread tensioning device of a sewing machine for forming multiple types of stitches using a plurality of threads is provided. The thread tensioning device includes thread tensioners disposed to correspond to the threads, an adjusting mechanism coupled to the thread tensioners to select a stitch type and to simultaneously adjust the tensional force applied from each of the thread tensioners to the corresponding thread such that the tensional force is selected from reference tensional forces corresponding to the selected stitch type, fine adjustment mechanisms disposed to correspond to the thread tensioners and to be manually operable to finely adjust the tensional force applied from the corresponding thread tensioner to the corresponding thread, and a reset mechanism coupled to the fine adjustment mechanisms to resets at different timings and interlockingly with the adjusting mechanism an amount of the tensional force finely adjusted by each of the fine adjustment mechanisms.

5 Claims, 10 Drawing Sheets

THREADING TENSIONING DEVICE OF SEWING MACHINE

CROSS-REFERENCE TO RELATED APPLICATION

The present application claims priority from Japanese Patent Application No. 2007-324624 filed on Dec. 17, 2007, the entire content of which is incorporated herein by reference.

FIELD OF INVENTION

The present invention relates to a thread tensioning device of a sewing machine which can adjust a tensional force of each of a plurality of threads.

DESCRIPTION OF RELATED ART

For example, in an overlock sewing machine, a plurality of threads to be inserted through a needle, an upper looper, and a lower looper are combined and used according to a type of stitch such as an over-edge chainstitch or a covering stitch. Therefore, a thread tensioning device is provided in which a thread tensioner including a pair of thread tensioning plates for sandwiching a thread and springs for applying sandwiching pressures to the thread tensioning plates is provided for each thread.

For example, the thread tensioning device described in U.S. Pat. No. 5,265,548 is configured so that spring pressures of the thread tensioners are set according to an operation for selecting a type of stitch so as to use reference tensional forces which are set in advance for the respective threads according to the type of stitch such as an over-edge chainstitch or a covering stitch, etc., to the respective threads to be used.

Further, fine adjustment mechanisms are provided which can change the spring pressures of the thread tensioners so as to finely adjust tensional forces to be applied to the threads by the respective thread tensioners from the reference tensional forces when expected seam quality cannot be obtained due to the reference tensional forces.

When the type of stitch is changed to another type of stitch, the thread tensioners are set so as to apply reference tensional forces corresponding to the newly selected type of stitch to the threads. In this case, the fine adjustment mechanisms changed for fine adjustment must be reset to the initial state. Therefore, a reset mechanism is provided which can reset the fine adjustment mechanisms interlockingly with the operation for changing the type of stitch.

However, in the reset mechanism of the related art described above, when the type of stitch is changed, all of the thread tensioners are reset simultaneously, so that a torque for actuating the reset mechanism is great.

Therefore, when the reset mechanism is structured so as to be manually operated, the load on the manual operation is great and imposes a burden on an operator.

In addition, when the reset mechanism is actuated by an actuator such as a motor, etc., the actuator with a high output must be provided so as to actuate the reset mechanism against a great load, and this increases the cost and poses problems such as an increase in electric power consumption.

SUMMARY OF THE INVENTION

It is an object of the present invention to restrain a torque increase when actuating a reset mechanism of a thread tensioning device.

An aspect of the present invention provides a thread tensioning device of a sewing machine, the sewing machine being operable to form a plurality of types of stitches using a plurality of threads. The thread tensioning device includes a plurality of thread tensioners disposed to correspond to the plurality of threads, each of the thread tensioners applying a tensional force to a respective one of the threads, an adjusting mechanism coupled to each of the thread tensioners, wherein the adjusting mechanism is configured to select a type of stitches from the plurality of types of stitches and to simultaneously adjust the tensional force applied from each of the thread tensioners to the corresponding threads such that, for each of the thread tensioners, the tensional force is selected from a plurality of reference tensional forces corresponding to the plurality of types of stitches so as to correspond to the selected type of stitches, a plurality of fine adjustment mechanisms disposed to correspond to the plurality of the thread tensioners, each of the fine adjustment mechanisms configured to be manually operable to finely adjust, from the selected reference tensional force, the tensional force applied from the corresponding one of the thread tensioners to the corresponding thread, and a reset mechanism coupled to each of the fine adjustment mechanisms, wherein the reset mechanism is configured to reset, at different timings and interlockingly with the adjusting mechanism, a respective amount of the tensional force that is finely adjusted by each of the fine adjustment mechanisms.

Another aspect of the present invention provides a thread tensioning device of a sewing machine, the sewing machine being operable to form a plurality of types of stitches using a plurality of threads. The thread tensioning device includes tensioning means for individually applying tensional force to each of the threads, adjusting means for selecting a type of stitches from the plurality of types of stitches and for simultaneously adjusting the respective tensional force individually applied from the tensioning means to each of the respective threads such that, for each of the threads, the tensional force is selected from a plurality of reference tensional forces corresponding to the plurality of types of stitches so as to correspond to the selected type of stitches, fine adjustment means for finely and individually adjusting, from the selected reference tensional force, the tensional force applied from the tensioning means to the respective threads, and reset means for resetting, at different timings and interlockingly with the adjusting means, a respective amount of the tensional force that is finely and individually adjusted by the fine adjustment means for each of the threads.

Still another aspect of the present invention provides a thread tensioning device of a sewing machine. The thread tensioning device includes a plurality of tensioning means disposed to correspond to a plurality of threads, an adjusting mechanism coupled to each of the tensioning means, wherein the adjusting mechanism is operable to simultaneously adjust, by driving a drive source or through manual operations for changing a sewing condition, tensional forces of the respective threads to reference values so as to correspond to the sewing condition, a fine adjustment mechanism disposed at each of the tensioning means so as to be manually operable to finely adjust the tensional force of each of the threads from the reference value individually, a reset mechanism which is provided to each of the fine adjustment mechanisms to reset, interlockingly with the adjusting mechanism the tensional force applied to each of the threads by the fine adjustment mechanism to the reference value, and a member which is provided in the reset mechanism to reset the tensional force of each of the threads to the reference value while making the timing of resetting the tensional force of each of the threads to the reference value different.

Other aspects and effects of the present invention will become clear from the following description, drawings, and claims.

DETAILED DESCRIPTION

Hereinafter, embodiments of the present invention will be described in detail with reference to the drawings. In the following embodiments, the present invention is applied to an overlock sewing machine. However, without limiting to the following embodiments, the present invention is also applicable to other types of sewing machines.

First Embodiment

Overall Configuration of Thread Tensioning Device

Figure 1:
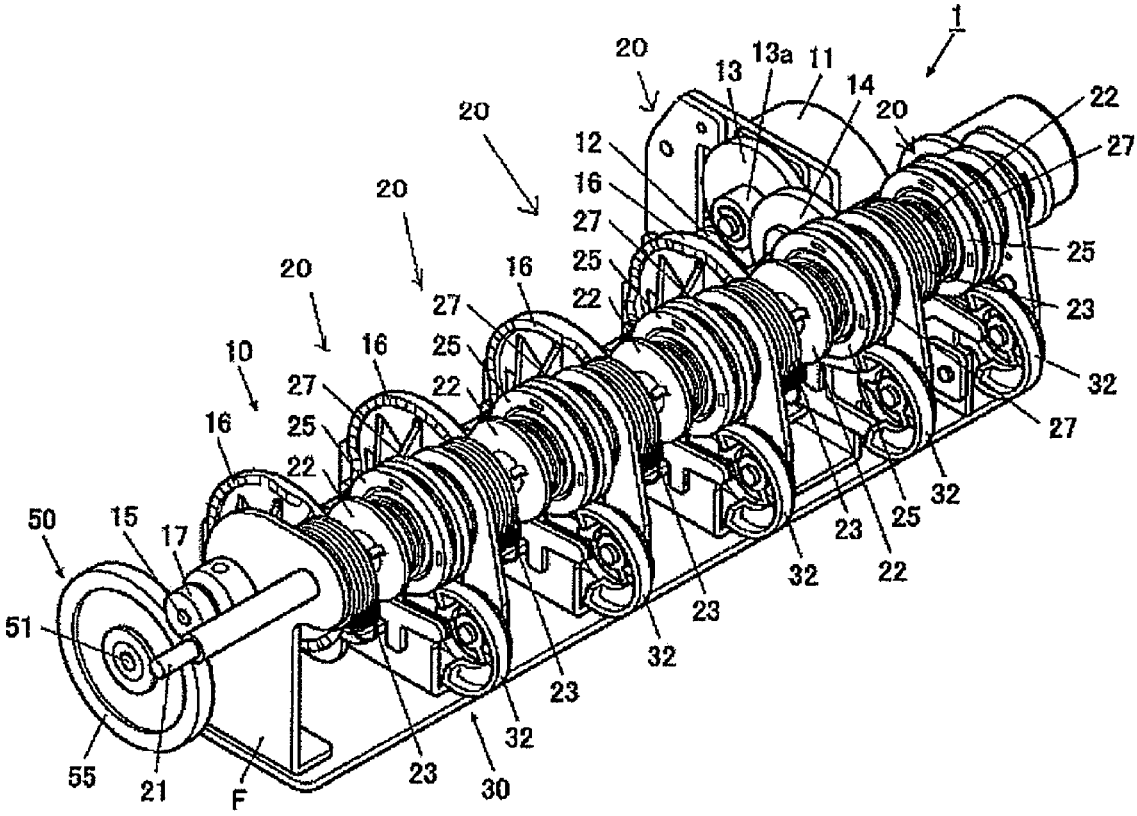
FIG. 1 is a perspective view of a thread tensioning device of a first embodiment of the present invention.

As shown in FIG. 1, a thread tensioning device 1 of a sewing machine includes a plurality of thread tensioners 20 (tensioning means) provided corresponding to a plurality of threads, respectively, an adjusting mechanism 10 (adjusting means) which adjusts thread tensional forces of the respective thread tensioners 20 to reference tensional forces so as to correspond to a type of stitch and sewing conditions simultaneously by one stepping motor 11 (drive source), fine adjustment mechanisms 30 (fine adjusting means) disposed to correspond to the respective thread tensioners 20 and manually operable to finely adjust tensional forces of threads individually from reference tensional forces, and a reset mechanism 50 (reset means) which simultaneously resets the amounts of tensional forces of the threads finely adjusted by the fine adjustment mechanisms 30. The adjusting mechanism 10 may be configured to be manually operated without providing the stepping motor 11.

Adjusting Mechanism

Figure 2:
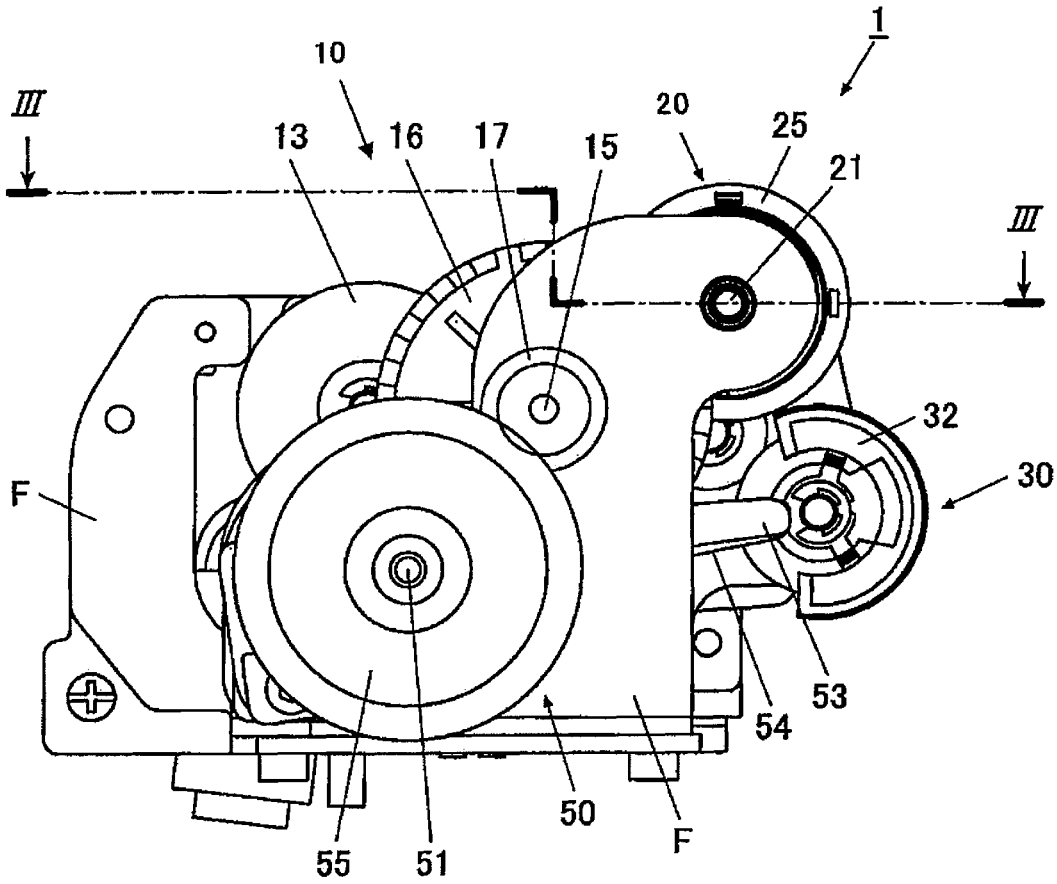
FIG. 2 is a side view of the thread tensioning device.
Figure 3:
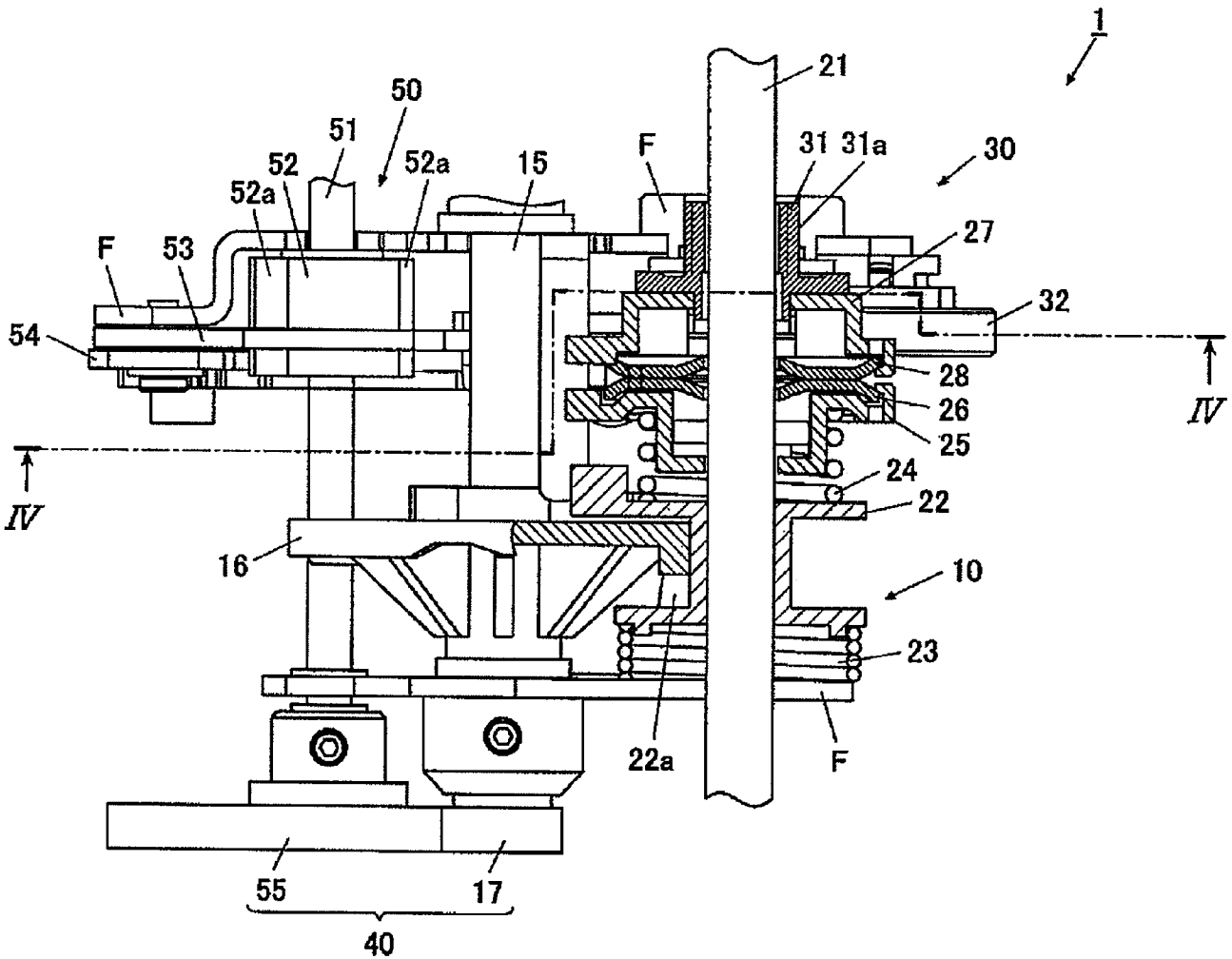
FIG. 3 is a sectional view along the II-II line of FIG. 2.

As shown in FIG. 1 to FIG. 3, the adjusting mechanism 10 includes a stepping motor 11 provided on a base F, a motor gear 12 which is provided on an output shaft of the stepping motor 11 and rotates together with the output shaft, a reduction gear 13 which engages with the motor gear 12, and an adjusting cam gear 14 provided so as to come into contact with a cam portion 13*a* formed on the reduction gear 13.

The adjusting cam gear 14 is axially supported rotatably by the adjusting cam shaft 15. The adjusting cam shaft 15 is supported on the base F. The adjusting cam shaft 15 is provided with a plurality of adjusting cams 16 corresponding to the thread tensioners 20 for the respective threads. On the adjusting cams 16, cam surfaces corresponding to tensional forces (reference tensional forces) to be applied to the respective threads according to sewing conditions such as a type of stitch, etc., are formed. The reference tensional forces to be applied to the respective threads such as the needle threads and upper and lower looper threads are different, so that the cam surfaces of the adjusting cams 16 are different among the thread tensioners 20. On one end portion of the adjusting cam shaft 15, a reset gear 17 described later is provided.

Thread Tensioner

On the base F, a thread tensioning shaft 21 is provided parallel to the adjusting cam shaft 15, and on the thread tensioning shaft 21, five thread tensioners 20 corresponding to a plurality of threads such as needle threads, the upper looper thread, and the lower looper thread, respectively, are arranged. The thread tensioners 20 are configured as follows.

The thread tensioning shaft 21 is provided with cam bearings 22 which come into contact with the adjusting cams 16 corresponding to the respective adjusting cams 16. The cam bearing 22 is formed into a cylindrical shape, and both ends thereof are expanded in diameter. On the cam bearing 22, a contact projection 22*a* which comes into contact with the adjusting cam 16 is formed. On the thread tensioning shaft 21, between the base F and one end portions of the cam bearings 22, compression springs 23 are provided. The compression springs 23 are provided in compressed states, and press the cam bearings 22 by their resilient forces. The adjusting cams 16 press the contact projections 22*a* against the urging forces of the compression springs 23.

On the other end portion of the cam bearing 22, a plate presser block 25 is provided while sandwiching an adjusting spring 24 therebetween. The plate presser block 25 is provided with a plate 26 for applying a tensional force to a tread. At a position opposite to the plate presser block 25, an adjusting block 27 is provided. The adjusting block 27 is provided with a plate 28 at a position opposite to the plate 26. In other words, a tensional force can be applied to the thread by the plate 26 and the plate 28.

Fine Adjustment Mechanism

As shown in FIG. 1 to FIG. 3, the fine adjustment mechanism 30 includes a fine adjusting gear 31 and a fine adjusting dial 32 manually operable to finely adjust a tensional force to be applied to a corresponding thread. The fine adjusting gear 31 and the fine adjusting dial 32 are provided for each thread tensioner 20. The fine adjusting gear 31 is movable in the axial direction of the thread tensioning shaft 21 with respect to the base F.

The fine adjusting dial 32 is provided rotatably on the base F. The fine adjusting dial 32 is formed into an arc shape in a sectional view shaped by notching a part of a cylinder.

On the fine adjusting gear 31, a screw groove 31*a* which screw-fits a screw groove formed on the base F is formed. Accordingly, the fine adjusting gear 31 moves in the axial direction of the thread tensioning shaft 21 by rotating around the thread tensioning shaft 21. The fine adjusting gear 31 is attached to the adjusting block 27 so that it is rotatable with respect to the adjusting block 27, however, it is restricted from moving in the axial direction of the thread tensioning shaft 21 with respect to the adjusting block 27. Therefore, the adjusting block 27 is movable along the axial direction of the thread tensioning shaft 21 together with the fine adjusting gear 31 according to rotation of the fine adjusting gear 31, but the fine adjusting gear 31 is restricted from separating from the adjusting block 27. The fine adjusting gear 31 is connected to the fine adjusting dial 32 via a reduction gear (not shown). In other words, by manually rotating the fine adjusting dial 32, the fine adjusting gear 31 can be rotated.

Reset Mechanism

As shown in FIG. 1 to FIG. 3, the reset mechanism 50 includes a reset cam shaft 51 provided on the base F, a reset cam 52 axially supported on the reset cam shaft 51, and reset levers 53, 54 which are provided so as to sandwich the outer edge of the reset cam 52 from two sides, and one end portions of which are coupled to each other rotatably, and the other end portions of which are engageable with the fine adjusting dial 32.

The reset cam shaft 51 is provided parallel to the adjusting cam shaft 15 and the thread tensioning shaft 21. On one end portion of the reset cam shaft 51, a reset gear 55 which engages with the reset gear 17 is provided. The reset gear 55 has four times as many teeth as those of the reset gear 17. In other words, the gear ratio of the reset gear 17 and the reset gear 55 is 4. The reset cam shaft 51 is coupled to the adjusting cam shaft 15 of the adjusting mechanism 10 via the reset gears 17 and 55, so that according to the rotation of the adjusting cam shaft 15, the reset cam shaft 51 also rotates interlockingly in a speed-reduced state. In other words, the reset gear 17 and the reset gear 55 compose a reduction mechanism 40.

Figure 4:
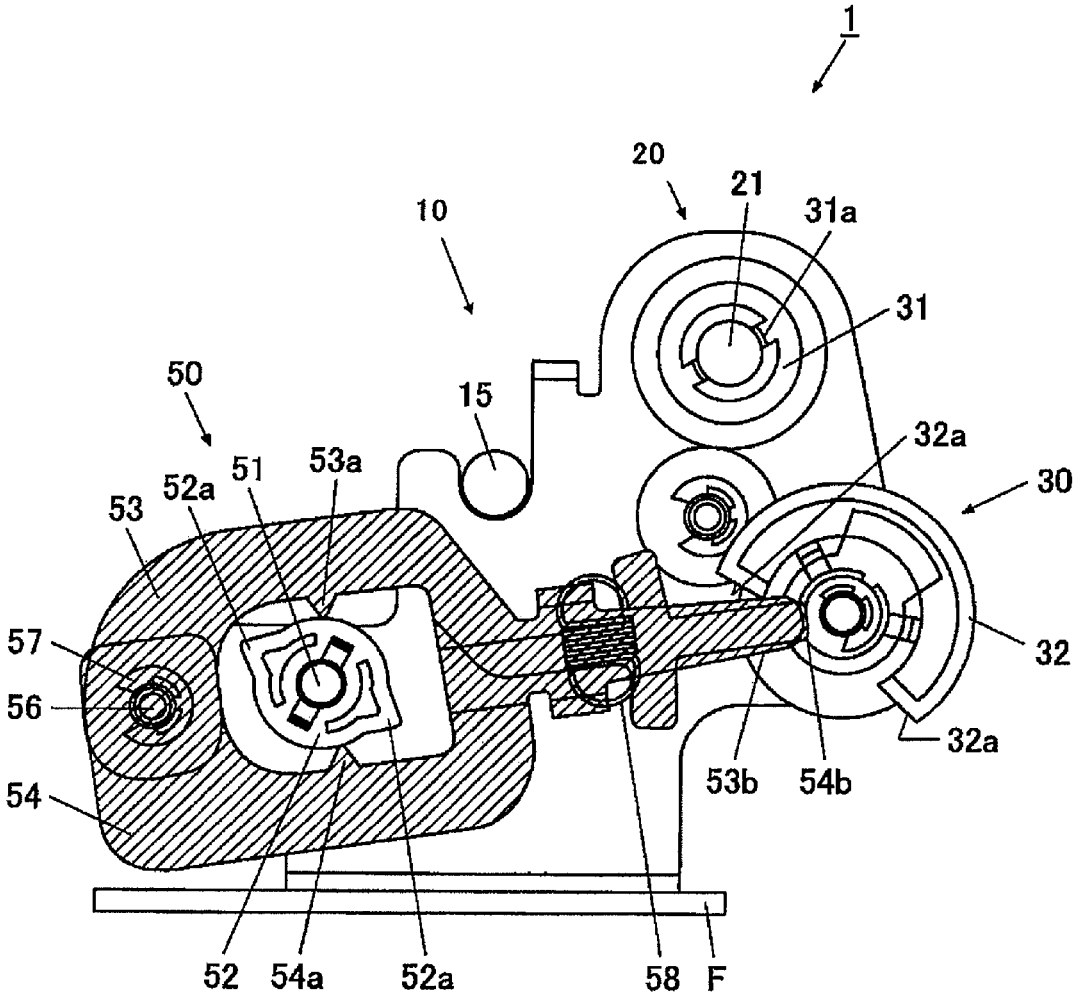
FIG. 4 is a sectional view along the IV-IV line of FIG. 3, showing a state of a fine adjustment mechanism before being reset by a reset mechanism.
Figure 5:
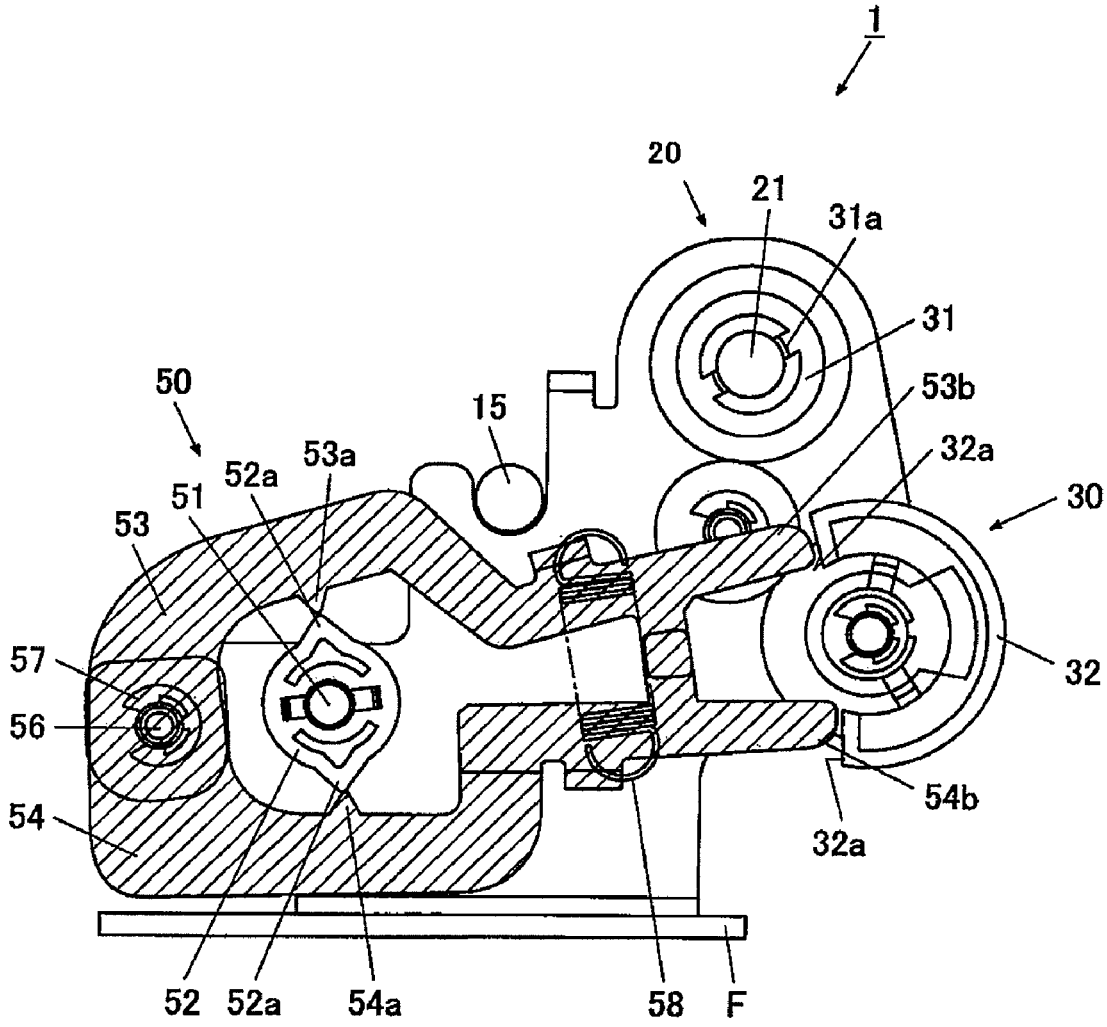
FIG. 5 is another sectional view along the IV-IV line of FIG. 3, showing a state of the fine adjustment mechanism reset by the reset mechanism.
Figure 6:
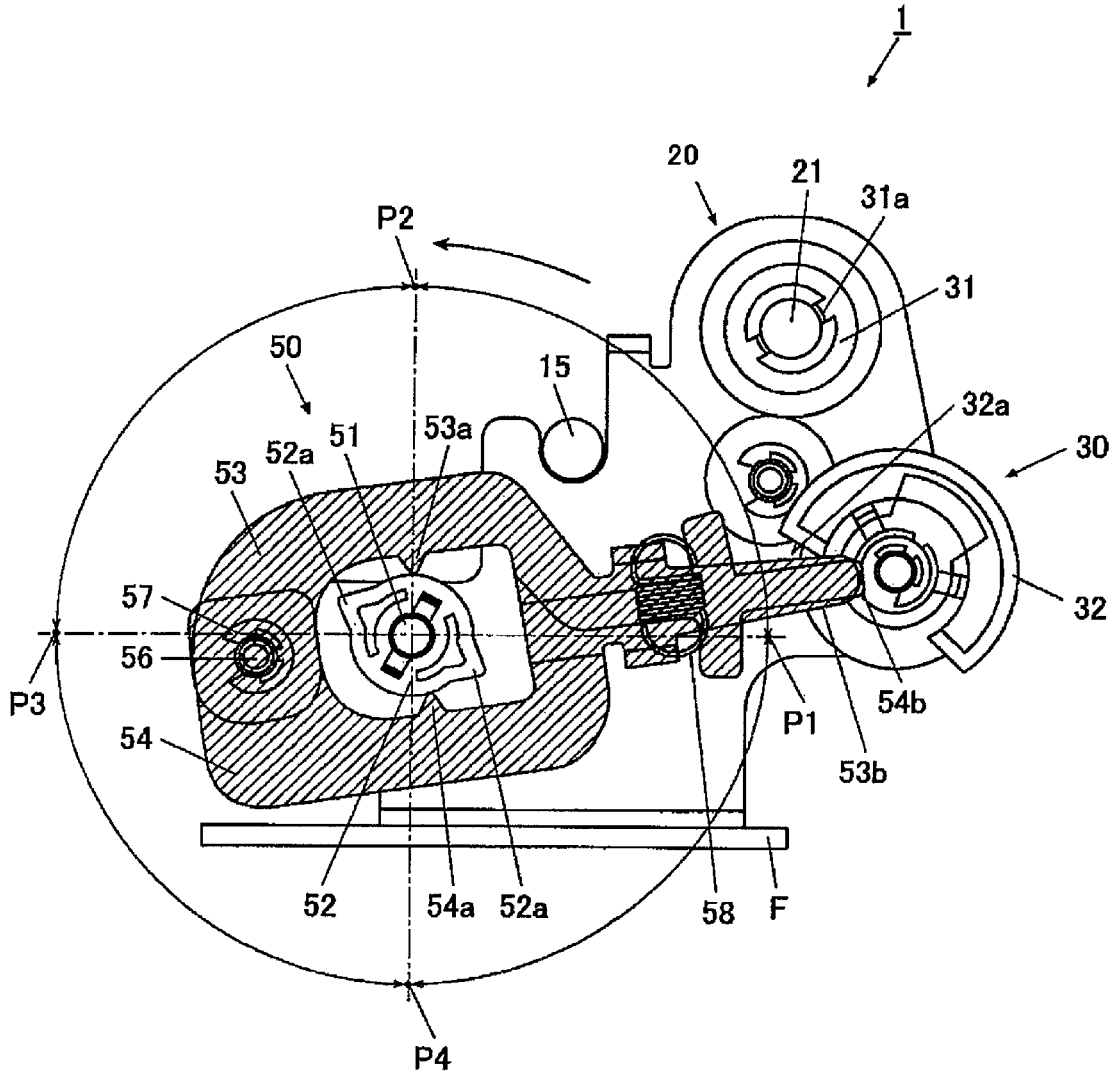
FIG. 6 is still another sectional view along the IV-IV line of FIG. 3, describing an operation of the reset mechanism.

As shown in FIG. 4 to FIG. 6, the reset cam 52 provided on the reset cam shaft 51 has projections 52*a* (drivers) projecting outward. The reset cam 52 is formed into a substantially disk shape in a front view, and rotates together with the reset cam shaft 51. The projections 52*a* are formed at positions on the reset cam 52 opposite to each other across the reset cam shaft 51. The projections 52*a* come into contact with the reset levers 53, 54 to drive the reset levers 53, 54 when the reset cam 52 rotates. The projections 52*a* are formed so that a straight line connecting the projections 52*a* passes through the center of the reset cam shaft 51. In other words, the angle between the straight lines connecting the center of the reset cam shaft 51 and the two projections 52*a* becomes 180 degrees.

Figure 7B:
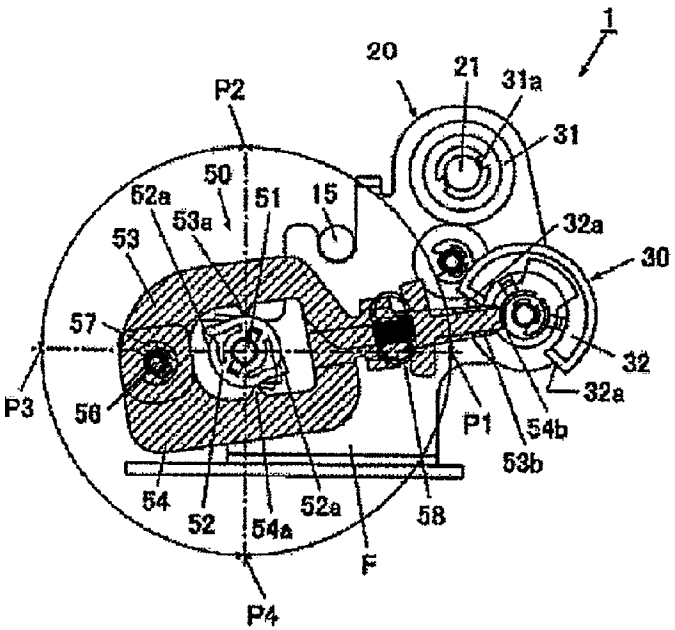
FIG. 7B is a side view of a part of the thread tensioning device shown in FIG. 7A.

As shown in FIG. 7B, the reset cams 52 provided in the reset mechanism 50 are set on the reset cam shaft 51 so that the projections 52*a* are at different positions (different rotation angle positions) in the rotating direction. In other words, the reset cams 52 are attached to the reset cam shaft 51 so that their attached positions deviate from each other in the rotating direction as viewed from the axial direction of the reset cam shaft 51. Therefore, when rotating the reset cam shaft 51, the timings at which the projections 52*a* of the reset cams 52 come into contact with the reset levers 53, 54 are made different by the arrangement intervals in the rotating direction of the projections 52*a* of the reset cams 52.

The reset levers 53, 54 are driven by the operation of the reset cam 52 to return the fine adjusting dial 32 to the initial position.

The reset lever 53 is formed to cover the reset cam 52 from above and extend toward the fine adjusting dial 32. On an outer edge portion of the reset lever 53 opposite to the reset cam 52, a projection 53*a* which comes into contact with the outer edge of the reset cam 52 is formed. The reset lever 54 is formed so as to cover the reset cam 52 from below and extend toward the fine adjusting dial 32. On an outer edge portion of the reset lever 54 opposite to the reset cam 52, a projection 54*a* which comes into contact with the outer edge of the reset cam 52 is formed.

As shown in FIG. 4, the projections 53*a*, 54*a* are always in contact with the outer edge of the reset cam 52. Therefore, the projections 53*a*, 54*a* move following the shape of the outer edge of the reset cam 52, and drive the reset levers 53, 54 so that they approach and separate in accordance with the rotation of the reset cam 52. For example, as shown in FIG. 5, when the reset cam 52 rotates and the projections 52*a* of the reset cam 52 and the projections 53*a*, 54*a* of the reset levers 53, 54 come into contact with each other oppositely to each other, the reset levers 53, 54 rotate around one end portions thereof by the heights of the projections 52*a*, 53*a*, 54*a*.

One end portions of the reset levers 53, 54 are coupled rotatably by a shaft member 56 and an E-ring 57. The other end portions of the reset levers 53, 54 are formed so as to come into contact with a contact surface 32*a* formed into a notched surface of the fine adjusting dial 32. The reset levers 53, 54 are coupled by a spring 58 between the one end portions and the other end portions, and the other end portions of the reset levers are urged to approach each other.

When the gear ratio of the reset gear 17 and the reset gear 55 is 4, the reset gear 55 rotates by ¼ during 360-degree rotation of the reset gear 17. Therefore, the resetting operation by the reset mechanism 50 is not always interlocked with a changing operation to reference tensional forces corresponding to a type of stitch performed by the adjusting mechanism 10.

In detail, before the operation of the thread tensioning device 1, in a case where the projections 52*a* of the reset cam 52 are disposed so as to turn to P1, P3 shown in FIG. 6, when the thread tensioning device 1 is operated from this state, the projections 52*a* of the reset cam 52 turn to P2, P4 and come into contact with the projections 53*a*, 54*a* of the reset levers 53, 54 and the reset levers 53, 54 rotate against the urging force of the spring 58 when the adjusting cam shaft 15 enters the second rotation and the fourth rotation. According to the rotations of the reset levers 53, 54, the other end portions of the reset levers 53, 54 rotate to separate from each other and come into contact with the contact portion 32*a* of the fine adjusting dial 32, whereby the fine adjusting dial 32 is rotated. By this series of operations, the amounts of tensional forces finely adjusted by the fine adjusting dial 32 can be reset.

Therefore, in an odd-number-th rotation of the adjusting cam shaft 15, the adjusting mechanism 10 can apply reference tensional forces corresponding to a desired type of stitch to the respective threads without resetting operations by the reset mechanism 50, and in an even-number-th rotation of the adjusting cam shaft 15, the amounts of tensional forces finely adjusted by the fine adjustment dials 32 can be reset. In other words, by the adjusting mechanism 10 solely, the operation for applying reference tensional forces to the respective threads and the operation for resetting by the reset mechanism 50 the amounts of tensional forces finely adjusted by the fine adjustment mechanisms 30 can be performed alternately.

Explanation of Operations of Thread Tensioning Device

Next, operations of the thread tensioning device 1 will be described.

When the stepping motor 11 is driven in response to an operation for selecting a type of stitch, the adjusting cam shaft 15 rotates via the motor gear 12, the reduction gear 13, and the adjusting cam gear 14. According to the rotation of the adjusting cam shaft 15 corresponding to the selected type of stitch, the adjusting cams 16 also rotate to predetermined rotation angles, and according to the cam shapes of the adjusting cams 16 which come into contact with the contact projections 22*a*, that is, according to the cam shapes corresponding to reference tensional forces corresponding to the selected type of stitch, the cam bearings 22 move in the axial direction of the thread tensioning shaft 21.

The urging forces applied from the adjusting springs 24 to the plate presser blocks 25 are changed by the movements of the cam bearings 22, so that the urging forces of the plates 26 to be applied to the plates 28 also change, and accordingly, the tensional forces to be applied to the treads can be changed.

By rotating the fine adjustment dials 32, the adjusting blocks 27 can be arbitrarily moved along the thread tensioning shaft 21 according to the rotation amounts of the fine adjustment dials 32, so that the lengths in the urging direction of the adjusting springs 24 are changed, and the tensional forces to be applied to the threads between the plates 26 and the plates 28 can be finely adjusted from the reference tensional forces.

The rotation of the adjusting cam shaft 15 is transmitted to the reset cam shaft 51 via the reset gears 17 and 55, so that the reset cams 52 provided on the reset cam shaft 51 also rotate.

However, in the first rotation of the adjusting cam shaft 15, the projections 52*a* of the reset cam 52 and the projections 53*a*, 54*a* of the reset levers 53, 54 do not come into contact with each other, so that the reset levers 53, 54 do not rotate, and the fine adjusting dial 32 does not move, either. Therefore, the amount of tensional force finely adjusted by the fine adjusting dial 32 is not reset.

When the stepping motor 11 is further driven and the adjusting cam shaft 15 enters the second rotation, the projections 52*a* of the reset cam 52 and the projections 53*a*, 54*a* of the reset levers 53, 54 come into contact with each other, and the other end portions 53*b*, 54*b* of the reset levers 53, 54 rotate around a shaft member 56 so as to separate from each other. Accordingly, one of the other end portions 53*b*, 54*b* of the reset levers 53, 54 presses the fine adjusting dial 32, and the fine adjusting dial 32 rotates in a direction returning to the initial position, and the amount of tensional force finely adjusted by the fine adjusting dial 32 is reset.

In the third rotation of the adjusting cam shaft 15, the projections 52*a* of the reset cams 52 and the projections 53*a*, 54*a* of the reset levers 53, 54 do not come into contact with each other, so that the reset levers 53, 54 do not rotate, and the fine adjusting dial 32 does not rotate, either. Therefore, the amount of tensional force finely adjusted by the fine adjusting dial 32 is not reset.

When the adjusting cam shaft 15 enters the fourth rotation, the projections 52*a* of the reset cam 52 and the projections 53*a*, 54*a* of the reset levers 53, 54 come into contact with each other and the other end portions 53*b* and 54*b* of the reset levers 53, 54 rotate around the shaft member 56 so as to separate from each other. Accordingly, the other end portions 53*b* and 54*b* of the reset levers 53, 54 press the fine adjusting dial 32, and the fine adjusting dial 32 rotates in a direction returning to the initial position, and the amount of tensional force finely adjusted by the fine adjusting dial 32 is reset.

Next, timings of reset operations by the reset cams 52 at the time of the operation of the thread tensioning device 1 will be described.

Figure 7A:
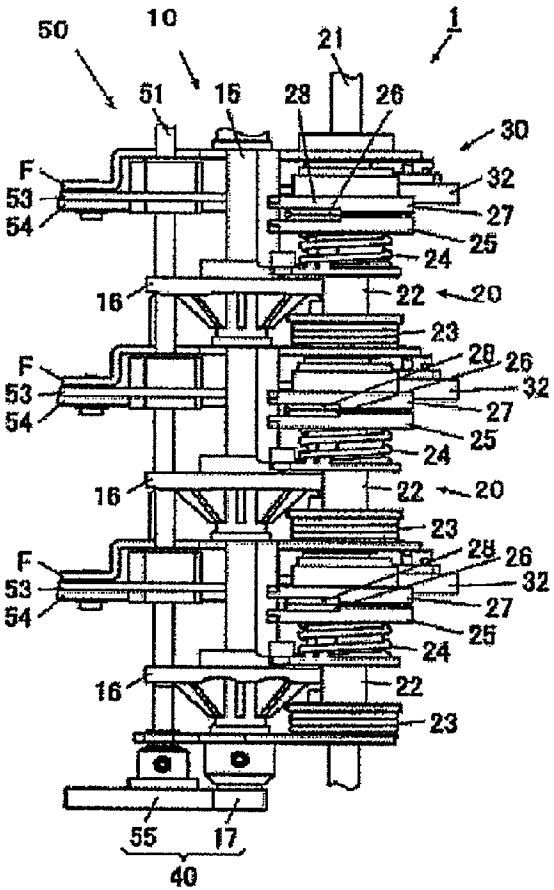
FIG. 7A is a plan view of a part of the thread tensioning device.

As shown in FIG. 7A, reset operations for the fine adjustment mechanisms 30 of three thread tensioners 20 will be described in a focused manner. According to the rotation of the thread tensioning shaft 21, when the reset cam shaft 51 is rotated via the reset gears 17 and 55, the reset cams 52 provided on the reset cam shaft 51 also rotate. At this time, as shown in FIG. 7B, the reset cams 52 are provided so that the projections 52*a* thereof deviate from each other in the rotating direction of the reset cam shaft 51, so that the phases of contacts of the projections 52*a* with the corresponding reset levers 53, 54 are different from each other.

In detail, in FIG. 7A, the projections 52*a* of the reset cam 52 of the upper thread tensioner 20 come into the earliest contact with the projections 53*a*, 54*a* of the corresponding reset levers 53, 54, and next, the projections 52*a* of the corresponding reset cams 52 of the middle thread tensioner 20 come into contact with the projections 53*a*, 54*a* of the corresponding reset levers 53, 54, and the projections 52*a* of the corresponding reset cam 52 of the lower thread tensioner 20 come into the latest contact with the projections 53*a*, 54*a* of the corresponding reset levers 53, 54.

Figure 8A:
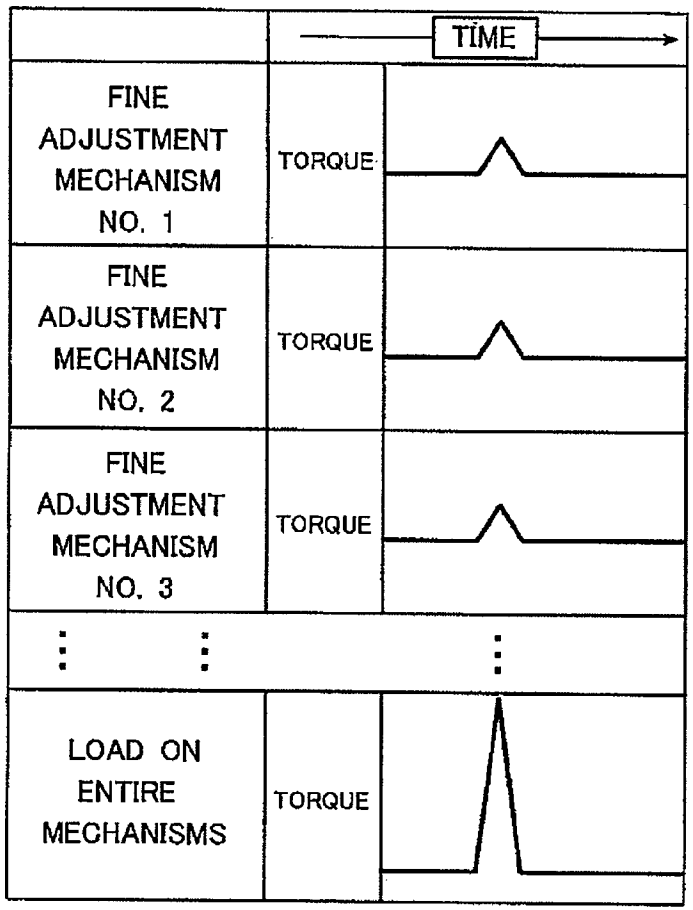
FIG. 8A is a view showing a loading torque in a case where all reset cams are provided in the same phase with respect to a rotating direction of a reset cam shaft.

As shown in FIG. 8A, when all reset cams 52 drive the corresponding reset levers 53, 54 at the same timing, the projections 52*a* come into contact with the projections 53*a*, 54*a* of the reset levers 53, 54 and torques necessary for moving the reset levers 53, 54 act on the reset cam shaft 51 simultaneously, so that an increase in torque to act on the reset cam shaft 51 is great.

Figure 8B:
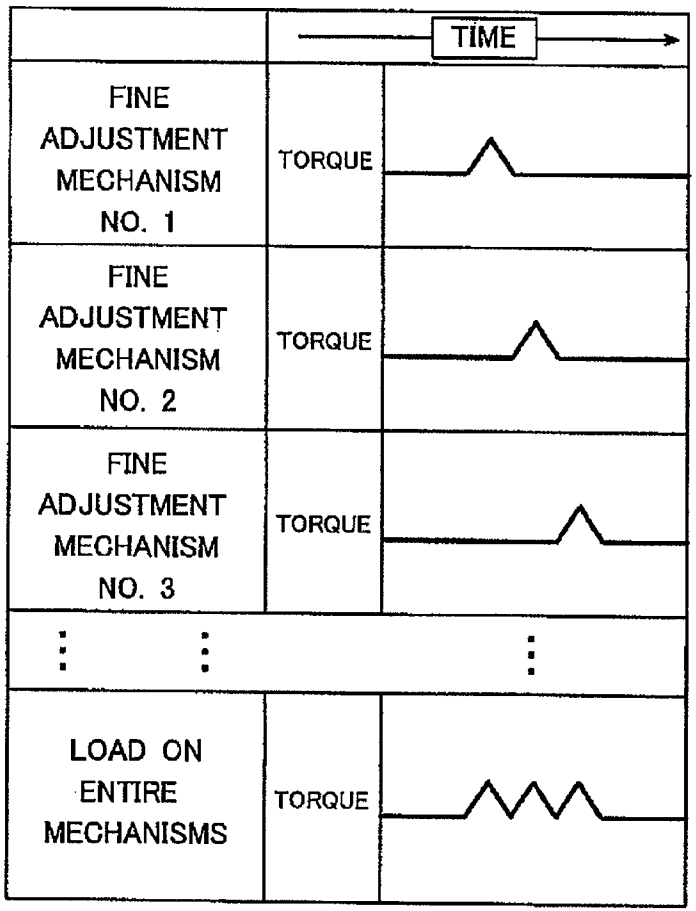
FIG. 8B is a view showing a loading torque in a case where all reset cams are provided in different phases with respect to the rotating direction of the reset cam shaft.

On the other hand, as shown in FIG. 8B, when the attached positions of the reset cams 52 are deviated from each other in the rotating direction of the reset cam shaft 51, the time periods during which the torques necessary for the projections 52*a* to move the projections 53*a*, 54*a* of the reset levers 53, 54 act on the reset cam shaft 51 do not overlap each other. Therefore, the torque acting at one time on the reset cam shaft 51 is a torque necessary for a reset operation for one thread tensioner 20 at most.

Thus, according to the thread tensioning device 1 of a sewing machine, the reset cams 52 of the reset mechanism 50 reset the amounts of tensional forces finely adjusted by the fine adjusting dials 32 at different timings.

In other words, when the reset cam shaft 51 rotates interlockingly with the operation of the adjusting mechanism 10, the reset cams 52 also rotate. By the rotating operation of the reset cams 52, the projections 52*a* formed on the reset cams 52 come into contact with the projections 53*a*, 54*a* of the reset levers 53, 54 and drive the reset levers 53, 54.

Here, the reset cams 52 are provided on the reset cam shaft 51 so that the projections 52*a* of the respective reset cams 52 are at different positions in the rotating direction of the reset cam shaft 51, so that when the reset cam shaft 51 rotates, the projections 52*a* of the reset cams 52 do not come into contact with the corresponding reset levers 53, 54 simultaneously.

Accordingly, even when a plurality of fine adjustment mechanisms 30 are provided, simultaneous resetting of the amounts of tensional forces applied to the threads finely adjusted by the fine adjustment mechanisms 30 does not occur. Therefore, the drive torque for driving the reset mechanism 50 can be restrained from increasing.

Second Embodiment

Next, a second embodiment of the present invention will be described. The thread tensioning device 1*a* of the second embodiment is different in the configuration of the reset cams 82 from the first embodiment, so that the configuration of the reset cams 82 will be mainly described, and the same components as those in the first embodiment are attached with the same reference numerals and description thereof is omitted.

Configuration of Reset Cam

Figure 9:
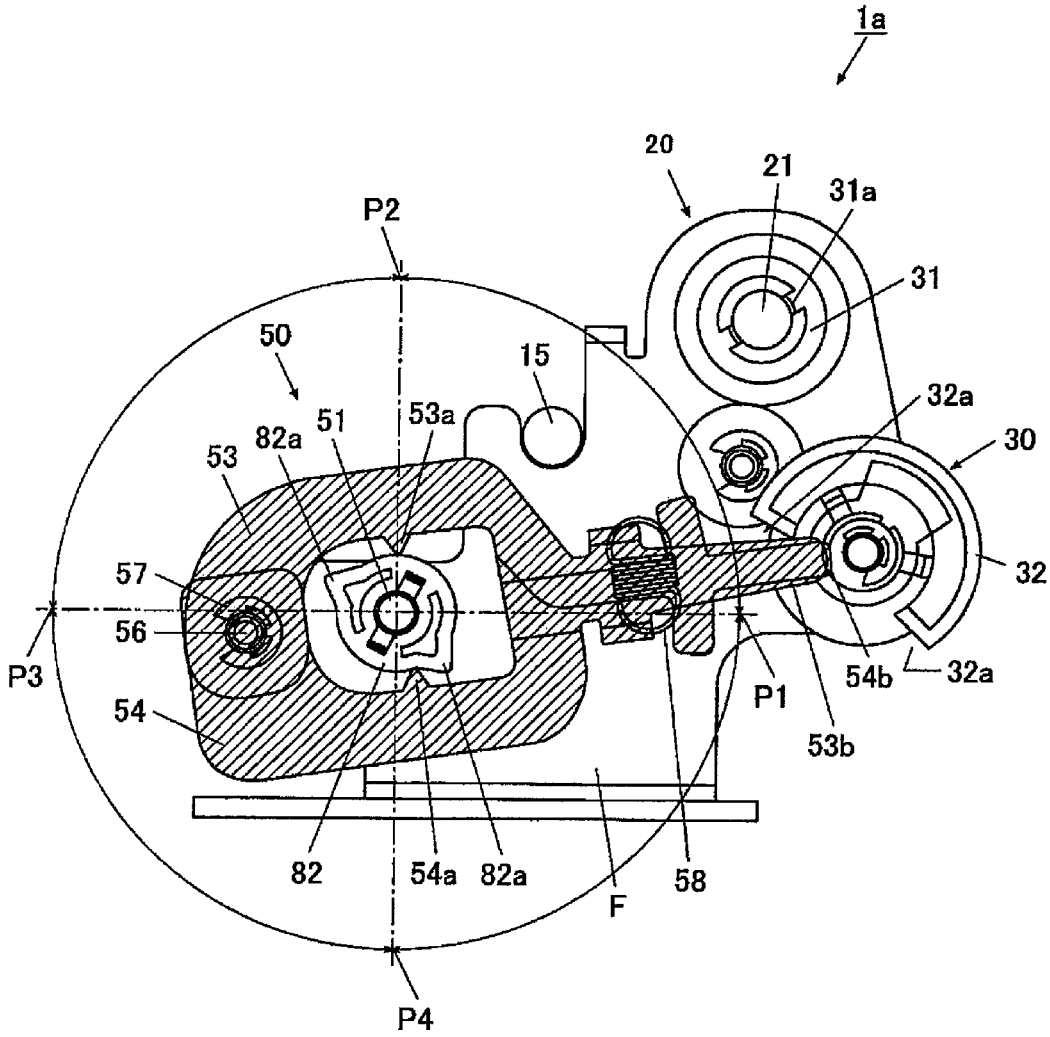
FIG. 9 is a sectional view of a thread tensioning device of a second embodiment of the present invention.

As shown in FIG. 9, in the reset cams 82 provided on the reset cam shaft 51, the projections 82*a* (drivers) are formed asymmetrically about the line passing through the center of the reset cam shaft 51. In other words, the angle between the lines connecting the center of the reset cam shaft 51 and the two projections 82*a* is not 180 degrees. With this configuration, the timing at which one of the projections 82*a* comes into contact with the reset lever 53 and the timing at which the other projection 82*a* comes into contact with the reset lever 54 are made different from each other, whereby the time periods of movements of the reset levers 53, 54 can be prevented from overlapping.

Next, timings of reset operations by the reset cams 82 at the time of operation of the thread tensioning device 1*a* will be described.

Figure 10A:
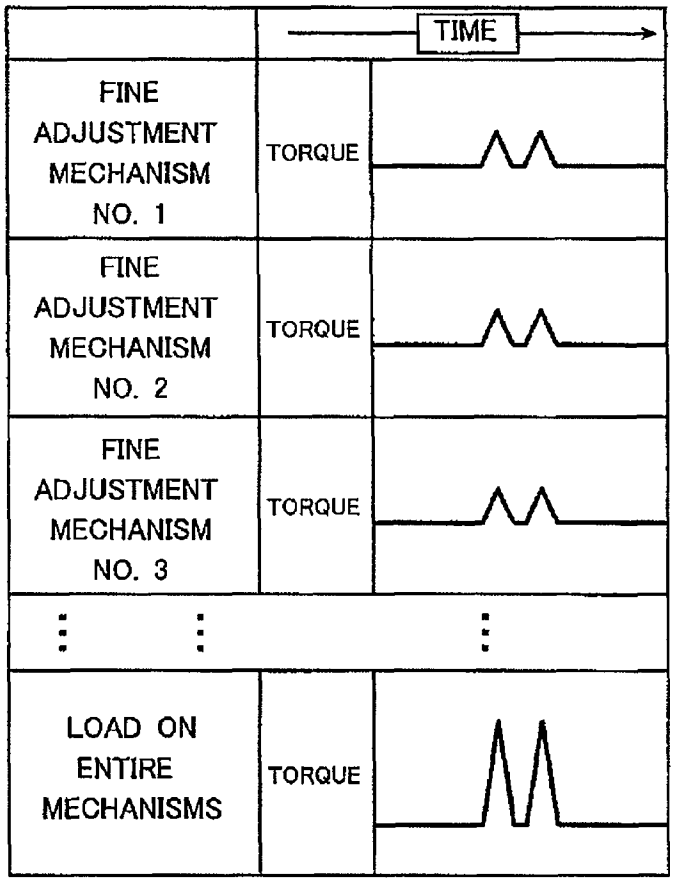
FIG. 10A is a view showing a loading torque in a case where positions of projections of reset cams are deviated from each other in the circumferential direction of the reset cams and all reset cams are provided in the same phase with respect to the rotating direction of the reset cam shaft.
Figure 10B:
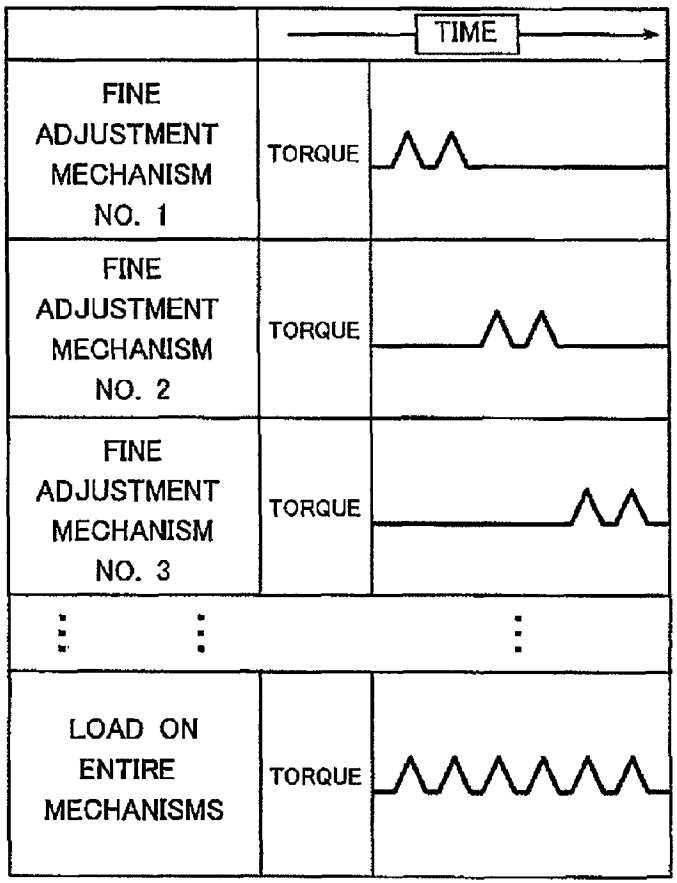
FIG. 10B is a view showing a loading torque in a case where the positions of the projections of the reset cams are deviated from each other in the circumferential direction of the reset cams and all reset cams are provided in different phases with respect to the rotating direction of the reset cam shaft.

As in the case of the first embodiment, reset operations for the corresponding fine adjustment mechanisms 30 of three thread tensioners 20 will be described in a focused manner. According to the rotation of the thread tensioning shaft 21, when the reset cam shaft 51 is rotated via the reset gears 17, 55, the reset cams 82 of the reset mechanisms 50 provided on the reset cam shaft 51 also rotate. At this time, as shown in FIG. 10A, when the timing at which one of the projections 82*a* of each reset cam 82 comes into contact with the reset lever 53 and the timing at which the other projection 82*a* comes into contact with the reset lever 54 are different from each other, the time periods of movements of the reset levers 53, 54 do not overlap each other. Therefore, when the reset levers 53, 54 are moved, forces applied from the spring 58 are half the forces applied from the spring 58 when the reset levers 53, 54 are moved simultaneously. Further, as shown in FIG. 10B, the positions at which the reset cams 82 are provided on the reset cam shaft 51 are deviated from each other in the rotating direction of the reset cam shaft 51, so that the time periods of the movements of the reset levers 53, 54 do not overlap between the reset cams 82. Therefore, on the reset cam shaft 51, a torque necessary for moving one reset lever at each timing of movement of each of the reset levers 53, 54 acts. Thus, whichever of the reset lever 53, 54 is moved, the torque acting on the reset cam shaft 51 at one time is a torque necessary for moving one reset lever at most.

Thus, according to the thread tensioning device 1 of a sewing machine, the reset cams 82 of the reset mechanisms 50 reset the amounts of tensional forces finely adjusted on the respective threads at different timings, so that the torque necessary for resetting each fine adjustment mechanism 30 can be made small.

In other words, when the reset cam shaft 51 rotates interlockingly with the operation of the adjusting mechanism 10, the reset cams 82 also rotate. By the rotating operation of the reset cams 82, the projections 82*a* formed on the reset cams 82 come into contact with the projections 53*a*, 54*a* of the reset levers 53, 54 and drive the reset levers 53, 54.

Here, in each reset cam 82, two projections 82*a* are formed at positions which are not opposed to each other in the circumferential direction of the reset cam 82, so that when the reset cam shaft 51 rotates, the projections 82*a* do not come into contact with the reset levers 53, 54 simultaneously. In other words, the projections 82*a* come into contact with the reset levers 53, 54 without overlapping of the time periods of movements of the reset levers 53, 54. Therefore, when the reset levers 53, 54 are moved, the force applied from the spring 58 is half the force in the case where the two reset levers 53, 54 are moved simultaneously. In other words, in the thread tensioning device 1*a* of the second embodiment, the reset mechanisms 50 can be driven with a torque smaller than in the first embodiment.

By deviating the positions at which the reset cams 82 are provided on the reset cam shaft 51 from each other in the rotating direction of the reset cam shaft 51, the time periods of movements of the reset levers 53, 54 do not overlap between the reset cams 82.

Accordingly, even when a plurality of fine adjustment mechanisms 30 are provided, the amounts of tensional forces applied to the threads finely adjusted by the fine adjustment mechanisms 30 are not reset simultaneously. Therefore, the drive torque for driving the reset mechanisms 50 can be restrained from increasing.

The present invention is not limited to the embodiments described above. For example, the timings of operations of the reset levers 53, 54 may be changed by changing the positions of the projections 53*a*, 54*a* formed on the reset levers 53, 54.

All reset cams do not necessarily have the same shape, and the positions of projections and outer shapes, etc., may be made different among the reset cams.

What is claimed is:

1. A thread tensioning device of a sewing machine, the sewing machine being operable to form a plurality of types of stitches using a plurality of threads, the thread tensioning device comprising:

a plurality of thread tensioners disposed to correspond to the plurality of threads, each of the thread tensioners applying a tensional force to a respective one of the threads, an adjusting mechanism coupled to each of the thread tensioners, wherein the adjusting mechanism is configured to select a type of stitch from the plurality of types of stitches and to simultaneously adjust the tensional force applied from each of the thread tensioners to the corresponding thread such that, for each of the thread tensioners, the tensional force is selected from a plurality of reference tensional forces corresponding to the plurality of types of stitches so as to correspond to the selected type of stitch, a plurality of fine adjustment mechanisms disposed to correspond to the plurality of the thread tensioners, each of the fine adjustment mechanisms configured to be manually operable to finely adjust, from the selected reference tensional force, the tensional force applied from the corresponding one of the thread tensioners to the corresponding thread, and a reset mechanism coupled to each of the fine adjustment mechanisms, wherein the reset mechanism is configured to reset, at different timings and interlockingly with the adjusting mechanism, a respective amount of the tensional force that is finely adjusted by each of the fine adjustment mechanisms.

2. The thread tensioning device according to claim 1, wherein each of the fine adjustment mechanisms comprises a fine adjusting dial configured to be manually operable to finely adjust the tensional force applied from the corresponding one of the thread tensioners to the corresponding thread, and wherein the reset mechanism comprises:

a reset cam shaft which rotates interlockingly with an operation of the adjusting mechanism, a plurality of reset cams disposed on the reset cam shaft to correspond to the plurality of fine adjustment mechanisms, wherein the plurality of reset cams is axially rotatable together with the reset cam shaft, and a plurality of reset levers disposed to correspond to the plurality of reset cams, wherein each of the reset levers is driven by a respective one of the reset cams to return the fine adjusting dial of the corresponding fine adjustment mechanism to a respective initial position, wherein each of the reset cams comprises a driver which drives the corresponding reset lever in accordance with a rotation of the reset cam shaft, and the plurality of reset cams are disposed on the reset cam shaft such that the respective drivers are arranged at different positions in a rotating direction of the reset cam shaft.

3. The thread tensioning device according to claim 1, wherein each of the fine adjustment mechanisms comprises a fine adjusting dial configured to be manually operable to finely adjust the tensional force applied from the corresponding one of the thread tensioners to the corresponding thread, and wherein the reset mechanism comprises:

a reset cam shaft which rotates interlockingly with an operation of the adjusting mechanism, a plurality of reset cams disposed on the reset cam shaft to correspond to the plurality of fine adjustment mechanisms, wherein the plurality of reset cams is axially rotatable together with the reset cam shaft, a plurality of reset levers disposed to correspond to the plurality of reset cams, wherein each of the reset levers is driven by a respective one of the reset cams to return the fine adjusting dial of the corresponding fine adjustment mechanism to a respective initial position, and a plurality of drivers formed to correspond to the plurality of reset cams, each of the drivers drives the corresponding reset lever in accordance with a rotation of the reset cam shaft, wherein each of the drivers is formed on the corresponding reset cams such that the respective drivers are arranged at different positions in a rotating direction of the reset cam shaft.

4. A thread tensioning device of a sewing machine, the sewing machine being operable to form a plurality of types of stitches using a plurality of threads, the thread tensioning device comprising:

tensioning means for individually applying a tensional force to each of the threads, adjusting means for selecting a type of stitch from the plurality of types of stitches and for simultaneously adjusting the respective tensional force individually applied from the tensioning means to each of the respective threads such that, for each of the threads, the tensional force is selected from a plurality of reference tensional forces corresponding to the plurality of types of stitches so as to correspond to the selected type of stitch, fine adjustment means for finely and individually adjusting, from the selected reference tensional force, the tensional force applied from the tensioning means to the respective threads, and reset means for resetting, at different timings and interlockingly with the adjusting means, a respective amount of the tensional force that is finely and individually adjusted by the fine adjustment means for each of the threads.

5. A thread tensioning device of a sewing machine comprising:

a plurality of tensioning means disposed to correspond to a plurality of threads, an adjusting mechanism coupled to each of the tensioning means, wherein the adjusting mechanism is operable to simultaneously adjust, by driving a drive source or through manual operations for changing a sewing condition, tensional forces of the respective threads to reference values so as to correspond to the sewing condition, a fine adjustment mechanism disposed at each of the tensioning means so as to be manually operable to finely individually adjust the tensional force of each of the threads from the reference value, a reset mechanism which is provided to each of the fine adjustment mechanisms to reset, interlockingly with the adjusting mechanism, the tensional force applied to each of the threads by the fine adjustment mechanism to the reference value, and a member which is provided in the reset mechanism to reset the tensional force of each of the threads to the reference value while making the timing of resetting the tensional force of each of the threads to the reference value different.

* * * * *